US005147049A

United States Patent [19]

Schwendemann et al.

[11] Patent Number: 5,147,049

[45] Date of Patent: Sep. 15, 1992

[54] SKI HOLDER

[75] Inventors: Horst Schwendemann; Friedwald Joos, both of Geislingen, Fed. Rep. of Germany

[73] Assignee: E. Raff Maschinenbav GmbH, Fed. Rep. of Germany

[21] Appl. No.: 727,905

[22] Filed: Jul. 10, 1991

[30] Foreign Application Priority Data

Jul. 16, 1990 [DE] Fed. Rep. of Germany ... 9010649[U]

[51] Int. Cl.[5] ..... A47F 7/00

[52] U.S. Cl. ..... 211/70.5; 211/4

[58] Field of Search ..... 211/70.5, 4, 9; 70/62

[56] References Cited

U.S. PATENT DOCUMENTS

| | | | |
|---|---|---|---|
| 3,275,160 | 9/1966 | Zurker | 211/4 X |
| 3,604,228 | 9/1971 | Conlon | 211/70.5 X |
| 3,685,667 | 8/1972 | Bell | 211/70.5 |
| 4,245,745 | 1/1981 | Verelle et al. | 211/70.5 X |
| 5,040,385 | 8/1991 | Randone | 211/4 X |

*Primary Examiner*—Alvin C. Chin-Shue
*Assistant Examiner*—Sarah A. Lechok
*Attorney, Agent, or Firm*—Fred Philpitt

[57] ABSTRACT

A ski holder for the temporary, theft-proof storage of skis comprises a vertical guide post (1) erected in a suitable manner, to which a ski-holding device (10) is attached so that it is infinitely adjustable. The ski-holding device (10) comprises a coin-operated locking device (4), whereof the bolt secures the skis (12) stored.

4 Claims, 2 Drawing Sheets

Figur 1
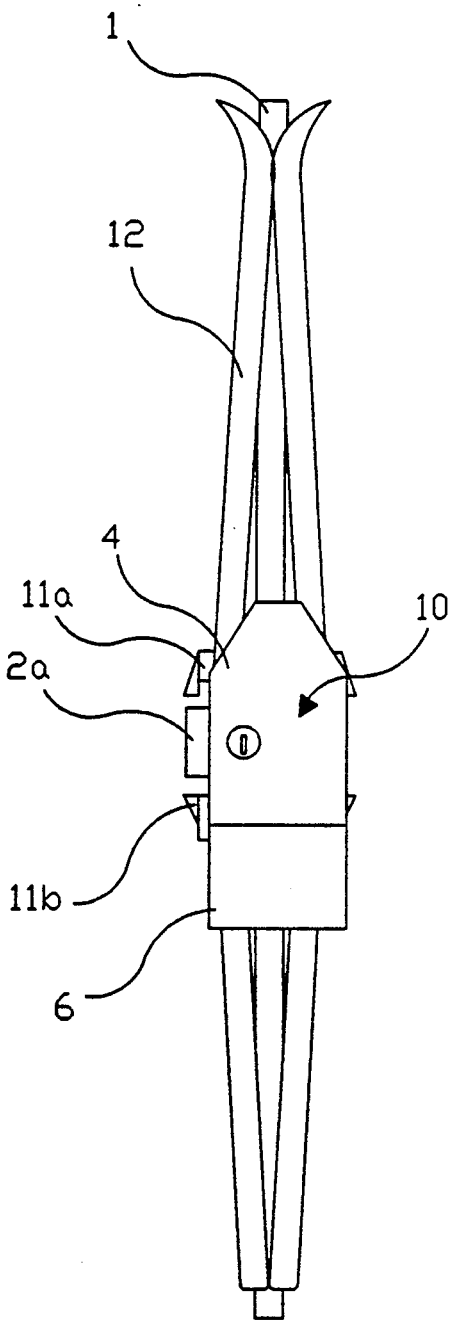
Figur 2
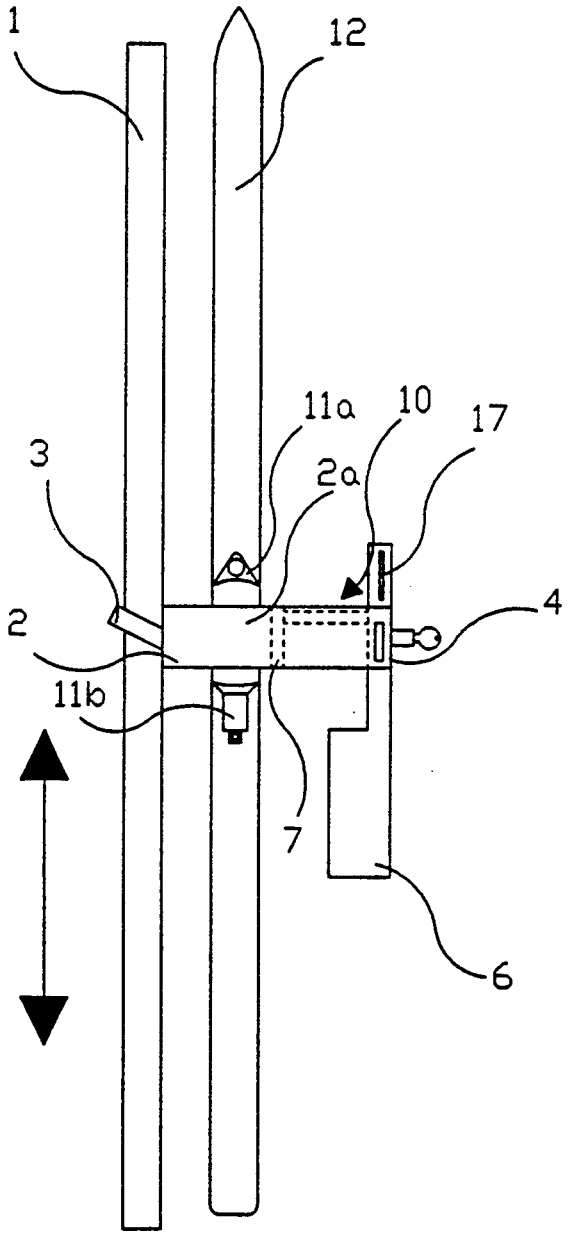

Figur 3
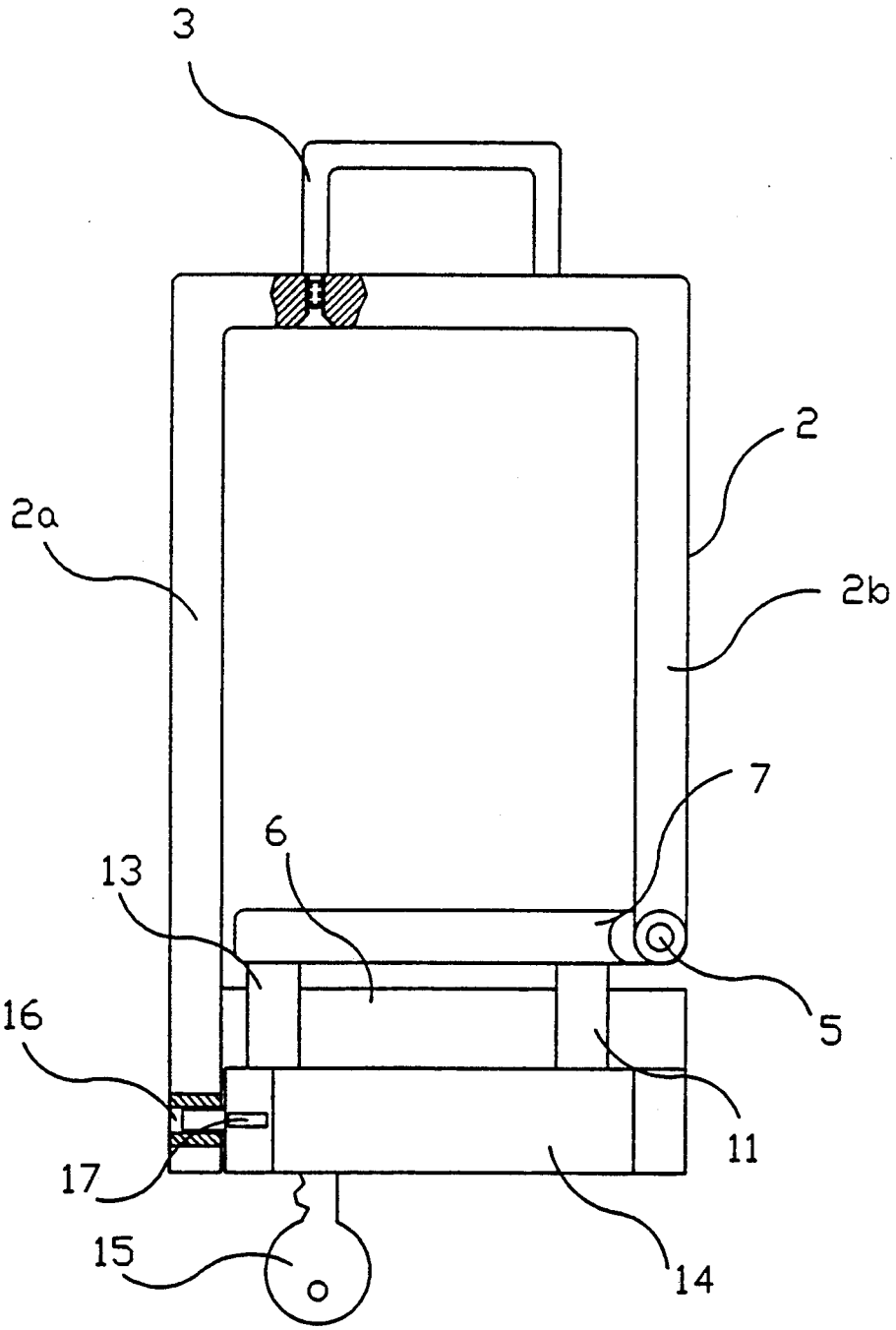

SKI HOLDER

The invention relates to a ski holder for the temporary, theft-proof storage of skis with a support structure, to which a lockable ski-holding device is attached.

Known ski holders of this type are provided with a stationary ski-holding device mounted securely on the support structure. The closing devices are not provided with an automatic coin-operated or pre-payment device. This means that staff are required for its operation. Partially, closing devices are used, which are controlled and charged for from a central control desk, which is located in ski cabins. For this purpose electrical connecting leads have to be laid between the ski holder and the control desk, since partly electromagnets as well as pressure switches and momentary-contact switches are necessary for assisting these systems. In other closing systems of a more simple type, a key or a token for a certain amount is issued at the cash-desk, by which the closing device of the ski holder can be operated. Thus, all known ski holders involve expenditure for staff, thus resulting in unnecessary costs.

It is the object of the present invention to develop a ski holder of the aforementioned type so that it is economical not solely in production but also in installation and operation.

This object is achieved according to the invention due to the fact that a) the support structure comprises at least one guide tube extending vertically;

b) the ski-holding device is attached to the guide tube so that it is infinitely adjustable;

c) the ski-holding device comprises a coin-operated locking device, whereof the key actuates a bolt preventing the removal of the skis in storage and which allows a removal of the key solely after the insertion of a coin.

All labour costs are eliminated in a ski holder according to the invention; the user is also saved the walk to a key issue point, a process which requires time, during which the skis are unsecured and liable to be stolen. The lock of the coin-operated locking device is only locked after the insertion of a coin; only then can the key be removed. If the lock is then once more unlocked, then a removal of the key is no longer possible. Thus, in so far as the user does not wish to leave his skis behind, no keys are lost, which would make an exchange of the lock necessary. Due to the infinite adjustment of the ski-holding device on the guide tube, an individual adaptation of the ski holder to any ski is possible. If the ski holder is located in the open air, the adjustment height can be varied on account of the snow conditions. In this case, an adaptation on the basis of the vertical adjustability of the ski-holding device is possible, without the intervention of staff being required. Furthermore, in this embodiment, the ski-holding device does not apply a load on the binding and does not stress the latter mechanically.

The attachment of the ski-holding device to the guide tube is particularly simple if the former comprises a guide bracket engaging around the guide tube, which tilts with respect to the guide tube under the weight of the ski-holding device and is secured axially thereby.

In this way, an infinite adjustment of the ski-holding device on the guide tube is possible without special attachment devices.

Securing the skis on the ski-holding device may take place for example so that the ski-holding device comprises a U-shaped retaining bracket, whereof both parallel legs are suitable for engaging between the binding jaws of a ski to be stored. The entire ski-holding device is thus positioned vertically so that the legs of the retaining bracket are located between the binding jaws of the skis to be stored, but do not apply any load on the binding.

In this embodiment of the securing device for the skis to be stored, according to a further feature of the invention it can be provided that pivoted on the outer end of one leg of the retaining bracket is a swinging arm, which supports the coin-operated locking device and together with the latter can be swung between an open position and a closed position, the bolt of the coin-operated locking device cooperating with a catch in the second leg.

Thus, in the open position of the swinging arm, the skis to be stored may be inserted from the front in the space surrounded by the U-shaped retaining bracket so that the two legs of the retaining bracket engage between the binding jaws of the skis. Then the swinging arm is brought into the locked position; after the insertion of a coin, the key is turned into the closed position and then removed.

For security reasons it is recommended that the swinging arm is pivoted by means of a safety bolt, which can be removed by a special tool.

Thus, if a key which has been removed is lost, then the skis located in the ski-holding device can be removed due to the fact that the operator dismantles the safety bolt with the special tool in his possession solely. After removing the safety bolt, the bolt of the coin-operated locking device can be lifted out of the catch; the swinging arm and coin-operated locking device can be removed together. The skis are now accessible.

One embodiment of the invention will be described in detail hereafter with reference to the drawings, in which:

FIG. 1 is a front view of a ski holder;

FIG. 2 is a side view of the ski holder of FIG. 1;

FIG. 3 is a plan view of the ski holder of FIG. 1.

The ski holder illustrated in the drawings comprises as the supporting member (support structure) a guide tube which is erected vertically in any known manner. For example it may be attached to the ground by a suitable foot or screwed to a wall by corresponding brackets. The actual ski-holding device, which is designated generally by the reference numeral 10 in the drawing, is attached to the guide tube 1 and indeed so that it is infinitely adjustable vertically above the ground with respect to this guide tube 1. For this purpose it comprises a guide bracket 3, which engages around the guide tube 1, but has an inside internal cross-section, which is somewhat greater than the cross-section of the guide tube 1. In this way, the guide bracket 3, as can be seen in particular from FIG. 2, tilts under the weight of the ski-holding device 10 with respect to the axis of the guide tube 1; at least one edge of the guide bracket 3 thus bears against the side face of the guide tube 1 so that without special further structural measures, the ski-holding device 10 is secured axially on the guide tube 1 by the guide bracket 3. If the entire ski-holding device 10 is to be adjusted vertically, then it is raised slightly by hand; the tilting of the guide bracket 3 on the guide tube 1 is thus cancelled and the guide bracket 3 with the ski-holding device 10 can be moved axially with respect to the guide tube 1.

Screwed to the guide bracket 3 is a substantially U-shaped retaining bracket 2 (see FIG. 3). The two lateral, parallel legs 2*a*, 2*b* of the retaining bracket 2 engage between the binding jaws 11*a*, 11*b* of the skis 12 placed in the inside of the retaining bracket 2, which in this way are secured at the top.

The leg 2*b* of the retaining bracket 2 shown on the right in FIG. 3 is somewhat shorter than the leg 2*a* shown on the left. At its end it supports a vertically extending pivot pin 5, on which one end of a swinging arm 7 is pivoted.

A coin-operated locking device 4 is fitted on the swinging arm 7, so that it is able to swing with the latter, by way of two spacer members 13, 14, which locking device 4 may have a commercial construction and therefore does not need to be described further. The coin-operated locking device 4 comprises an attached, closable coin store 6 (see in particular FIGS. 1 and 2) as well as a bolt, which due to the rotation of a key 15 can be inserted in a catch 16, which is formed in the longer leg 2*a* of the retaining bracket 2, on the left in FIG. 3. Provided on an upwardly pointing, inclined surface of the coin-operated locking device 4 is an insertion slot 17, through which the coin allowing the locking and withdrawal of the key 15 can be inserted.

The method of operation of the ski holder described is as follows:

A user, who wishes to store his skis in a theft-proof manner, generally finds the ski holder with the swinging arm 7 swung open. Alternatively, by turning the key 15 inserted in the coin-operated locking device 4, the bolt falls out of the catch 16, so that the swinging arm 7 can be swung outwards. By raising the ski-holding device 10 in the manner described above, the retaining bracket 2 is brought to the required height, so that the skis to be stored can be inserted with the binding jaws 11*a* and 11*b* on both sides of the legs 2*a* and 2*b* in the space surrounded by the retaining bracket 2. The swinging arm 7 is now brought once more into the closed position illustrated in FIG. 3, in which the skis can no longer be removed even forwards. The key 15 is turned so that the bolt of the coin-operated locking device 4 engages in the catch 16 on the leg 2*a* of the retaining bracket 2. After inserting a coin in the insertion slot 17, the key 15 can then be removed.

The removal of the skis takes place in the reverse manner:

By means of the key 15, the swinging arm 7 of the ski-holding device 10 can be unlocked and swung into the open position. The skis can then be removed in the forwards direction. The key 15 can now no longer be removed.

The pivot pin 5 is constructed as a safety bolt. That means that it can be removed by means of a special tool, which is solely in the possession of the operator. Thus, if a key 15 is lost, the pivot pin 5 can be removed by the operator; then the bolt of the coin-operated locking device 4 can be lifted out of the catch 16. The swinging arm and coin-operated locking device 4 can now be removed; the skis are now accessible.

We claim:

1. A ski holder for the temporary, theft-proof storage of skis with a support structure, to which a lockable ski-holding device is attached, characterized in that (a) said support structure comprises at least one guide tube
  (1) extending vertically;
(b) said ski-holding device (10) being attached to said guide tube (1) so that it is infinitely adjustable;
(c) said ski-holding device (10) comprising a coin-operated locking device (4) that includes a key (15) which actuates a bolt that prevents the removal of the skis in storage and allows removal of the key (15) solely after the insertion of a coin, and
(d) said ski-holding device (10) also including a guide bracket (3) engaging around said guide tube (1), which bracket tilts with respect to the guide tube (1) under the weight of the ski-holding device (10) and is secured axially thereby.

2. Ski holder according to claim 1, characterised in that the ski-holding device (10) comprises a U-shaped retaining bracket (2), whereof the two parallel legs (2*a*, 2*b*) are suitable for engaging between the binding jaws (11*a*, 11*b*) of a ski (12) to be stored.

3. Ski holder according to claim 2, characterised in that a swinging arm (7) is pivoted on the outer end of one leg (2*b*) of the retaining bracket (2), which swinging arm supports the coin-operated locking device (4) and can be swung together with the latter between an open position and a closed position, the bolt of the coin-operated locking device (4) cooperating with a catch (16) in the second leg (2*a*).

4. Ski holder according to claim 3, characterised in that the swinging arm (7) is pivoted by means of a safety bolt (5), which can be removed by a special tool.

* * * * *